United States Patent [19]

Lorson et al.

[11] 4,065,332

[45] Dec. 27, 1977

[54] HYBRID PROPELLANT COMPOSITIONS

[75] Inventors: Michel Pierre Lorson, Vert le Petit; Bernard Roger Dumas, Vert le Grand, both of France

[73] Assignee: Societe Nationale des Poudres et Explosifs, France

[21] Appl. No.: 639,930

[22] Filed: Dec. 11, 1975

Related U.S. Application Data

[62] Division of Ser. No. 422,728, Dec. 7, 1973, abandoned.

[30] Foreign Application Priority Data

Dec. 19, 1972 France ..... 72.45154

[51] Int. Cl.[2] ..... C06B 45/10

[52] U.S. Cl. ..... 149/19.9; 149/19.1; 149/19.4; 60/219

[58] Field of Search ..... 60/219, 220; 149/19.9, 149/19.5

[56] References Cited

U.S. PATENT DOCUMENTS

| | | | |
|---|---|---|---|
| 3,234,729 | 2/1966 | Altman et al. | 60/220 |
| 3,392,528 | 7/1968 | Moutet et al. | 60/220 |
| 3,476,622 | 11/1969 | Harada et al. | 149/19.9 X |
| 3,663,322 | 5/1972 | Sarten et al. | 149/19.9 |
| 3,717,997 | 2/1973 | Ayers et al. | 60/220 |
| 3,734,789 | 5/1973 | Moy et al. | 149/19.9 X |
| 3,790,416 | 2/1974 | Dehm | 149/19.9 X |

*Primary Examiner*—Edward A. Miller
*Attorney, Agent, or Firm*—Bucknam and Archer

[57] ABSTRACT

Solid components for hybrid propellants are disclosed, which comprise (1) a solid amine and (2) an organic binder, the binder a. being free of groups which are reactive with respect to the amine,
b. being selected from
   i. diene binders which may optionally contain functional groups and which can be vulcanized by reaction with sulphur,
   ii. binders comprising functional groups which can be cross-linked by an epoxide- or aziridinyl-containing cross-linking agent, and
   iii. polyurethane binders, and
c. being capable of hardening at a temperature lower than the melting point of the amine, the proportion of the binder being more than 15% by weight, based on the solid component.

2 Claims, No Drawings

HYBRID PROPELLANT COMPOSITIONS

This is a division, of application Ser. No. 422,728 filed Dec. 7, 1973, now abandoned.

These compositions can be moulded to shape with less danger of thermal decomposition of the amine, more readily that known solid component compositions.

This invention is concerned with hybrid propellant (or lithergol) compositions.

Hybrid propellants comprise a solid component which acts as the fuel and a liquid component which acts as the oxidiser. In known hybrid propellants, the solid component generally consists of an intimate mixture of a solid aromatic amine, such as 2,4-diaminotoluene, and an organic binder generally of the polyamide type. Amine-based solid components are very suitable when the liquid oxidiser is nitric acid, a nitrogen oxide or a mixture of these compounds. In the present state of the art, the solid components of hybrid propellants are produced by melting the amine-polyamide combination, pouring the molten mixture into a mould and solidifyng the mixture by cooling. Because of the considerable shrinkage during solidification, it is necessary for the mould to comprise a movable piston, the movement of which, caused by air pressure, compensates for this shrinkage. The moulding equipment is thus complex and the cooling cycle must be supervised very precisely in order to produce solid components which do not shown any porosity. In addition, there is a risk of degradation of the amine during melting which can affect the combustion of the solid component.

We have now found that these disadvantages can be avoided or reduced by using a hardenable liquid binder which can be cured to the solid state at a temperature below the melting point of the solid amine. The liquid binder is mixed with the solid amine to form a castable mixture, the latter is cast into a suitably shaped mould, and the mixture is then hardened in the mould at a temperature below the melting point of the amine. In this way, shrinkage of the solid component during solidification and melting of the amine can be avoided.

The proportion of binder with respect to the total composition (of the solid component) must be greater than 15% by weight in order to obtain a nonporous initial mixture or paste which does not have too high a viscosity. The majority of solid amines are not suitable, because amines, in powder form, react with numerous chemical groups (particularly epoxide, isocyanate and acid groups). Hardenable liquid binders must be used which do not react with the chosen, rather unreactive, solid amines.

According to the present invention, therefore, we provide a solid component for a hybrid propellant, which comprises (1) a solid amine and (2) an organic binder, the binder a. being free of groups which are reactive with respect to the amine, b. being selected from one of the following three groups:

i. diene binders which may optionally contain functional groups and which can be vulcanised by reaction with sulphur, ii. binders comprising functional groups which can be cross-linked by an epoxideor aziridinyl-containing cross-linking agent, and iii. polyurethane binders, and c. being capable of hardening at a temperature lower than the melting point of the amine, the proportion of the binder being more than 15% by weight, based on the solid component.

Preferred binders of these three types and preferred amines for use therewith (since not all the amines which are suitable for use with one type of binder are suitable for use with another type) are as follows.

i. Diene binders which can be vulcanised by reaction with sulphur (and other vulcanisation agents used in the rubber industry, such as magnesium oxide):

unsaturated polybutadiene binders which may optionally contain functional groups, butadiene/styrene copolymers, and butadiene/acrylonitrile copolymers, and unsaturated polyester binders. Amines which are suitable with this type of binder are, for example:

o-phenylene-diamine, m-phenylene-diamine, p-phenylene-diamine, 2,4-diamino-toluene, 2,6-diaminotoluene, 2,3-diamino-toluene, 3,4-diamino-toluene, 2,5-diamino-toluene, urea, and melamine, that is triamino-triazine of the formula:

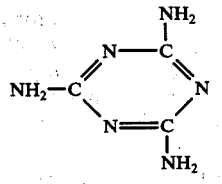

The melting points of these amines are as follows:

| | |
|---|---|
| ortho-phenylene-diamine | 102° C |
| meta-phenylene-diamine | 63° C |
| para-phenylene-diamine | 140° C |
| 2,4-diamine-toluene | 99° C |
| 2,6-diamino-toluene | 105° C |
| 2,3-diamino-toluene | 61° C |
| 3,4-diamino-toluene | 88.5° C |
| 2,5-diamino-toluene | 64° C |
| urea | 133° C |
| melamine | ≃350° C |

ii. Binders which polymerise by crosslinking with epoxides or aziridinyls:

carboxytelechelate polybutadiene binders, carboxytelechelate butadiene/styrene copolymers, and carboxytelechelate butadiene/acrylonitrile copolymers, and mixtures of these binders with organic polyacids.

Since the amine group reacts with epoxide and aziridinyl groups, it is necessary to use rather unreactive amines with these binders and only melamine, 2,4-diamino-toluene and 2,6-diamino-toluene are suitable.

iii. Binders of the polyurethane type, for which melamine is the only suitable solid amine.

The processing differs slightly depending on the type of binder used.

In the case of diene binders (type (i)), with the exception of unsaturated polyester binders, the binder and the amine are mixed in a Werner type mixer, under a pressure of a few millimeters of mercury. The mixing temperature is preferably about 70° C and is in every case below the melting point of the amine. The starting materials are introduced at the start of the mixing, except for the vulcanisation activator which is introduced ½ hour before casting. A wetting agent and a vulcanisation super-accelerator are preferably also used and are introduced ¼ hour before casting. The duration of the mixing is suitably from 3 to 6 hours.

After casting, the mixture must undergo heating for an extended period to complete curing and hardening. Curing must be carried out above a minimum of 30° C because vulcanisation at ambient temperature is very difficult. It is normally necessary with this type of binder to effect curing for 14 days at 40° C or for at least 3 days at 80° C. A temperature of 60° C is however preferable, because it is possible for partial decomposition of the amine to take place at 80° C.

The casting mixture preferably comprises a plasticiser for the binder and this may be either a conventional plasticiser for plastics or an amine-based plasticiser, such as xylidine.

In the case of unsaturated polyester binders, the processing is similar, but the mixing is preferably carried out at ordinary pressure with, however, degassing under partial vacuum (150 mm Hg) during mixing for half an hour after cooling to 20° C.

In the case of binders of type (ii), processing is carried out as follows:

The mixing is carried out in vacuo (a few millimeters of mercury), the cross-linking agent and the catalysts being introduced respectively 30 minutes and 10 minutes before casting. Since the viscosity of the mixture at 20° C is high and increases rapidly, it is necessary that the casting operation be carried out at 60° C. Under these conditions, the gel time of the mixture is about 30 minutes at 60° C. Polymerisation of the mixture takes place readily (7 days at 60° C) and the solid components obtained are very rigid at 20° C. In order to obtain these results, it is necessary to use a greater than the stoichiometric quantity of cross-linking agent.

Suitable plasticisers for this type of binder are, for example, dioctyl azelate, fuel and xylidine, the latter being particularly effective.

In the case of polyurethane binders (type (iii), produced from a mixture of isocyanates and polyols), only melamine is suitable. Processing is suitably carried out in the same way as for binders of type (ii).

In order that the invention may be more fully understood, the following examples are given by way of illustration only.

In the following examples, we have described the composition of the initial mixture from which the solid component is formed, the viscosity of this initial mixture (in most cases), the curing conditions used to harden the mixture (in most cases) and, in some cases, the hardness of the cured composition. It is to be understood that in each case, the initial mixture was formed by thorough mixing of the constituents mentioned, the mixture was then cast into a suitably shaped mould, and then hardened, in the mould, under the specified curing conditions. In the examples, all parts and percentages are by weight.

EXAMPLE 1

The binder used in the composition of this example was a polybutadiene binder cross-linked with sulphur and magnesium oxide. PBU 2000 = a polybutadiene having an average molecular weight of 2000.

| | | | |
|---|---|---|---|
| | PBU 2000 | 100 parts) | |
| | Sulphur | 4 parts) | |
| | MgO | 4 parts) | |
| Plasticiser | dioctyl azelate | 32 parts) | |
| Anti-oxidant | di-(tertiary butyl)-para-cresol | 2.8 parts) | |
| Wetting agent | stearic acid | 2.0 parts) | Binder 25% |
| | siloxane (γ-amino-propyl-triethoxy-silane) | 0.4 parts) | |
| Vulcanisation accelerators | di-ortho-tolyl guanidine | 2.0 parts) | |
| | zinc isopropyl-xanthate | 2.0 parts) | |
| Filler | 2,4-diamino-toluene | | 75% |
| Viscosity of the mixture | 7,200 poises at 60° C. | | |
| Curing | 10 days at 40° C or 5 days at 80° C. | | |
| Shore A hardness | 70. | | |

EXAMPLE 2

| | | | |
|---|---|---|---|
| | PBU 2000 | 100 parts) | |
| | Sulphur | 4 parts) | |
| | MgO | 2 parts) | |
| | ZnO | 2 parts) | |
| Plasticiser) Anti-oxidant) Wetting agent) Accelerators) | the same as in Example 1 | | Binder 25% |
| Filler | 2,4-diamino-toluene | | 75% |
| Viscosity of the mixture | 2,900 poises at 60° C. | | |
| Curing | 10 days at 60° C. | | |
| Shore A hardness | 55. | | |

EXAMPLE 3

This example shows the influence of the binder content on viscosity at casting and on the final hardness of the block, as compared with Example 2.

Composition identical to Example 2, but with 20% binder 80% filler.

Viscosity of the mixture: 8,000 poises at 60° C

Curing: 10 days at 60° C

Shore A hardness: 68.

EXAMPLE 4

This example illustrates the use of p-phenylenediamine as the filler.

| | | | |
|---|---|---|---|
| | PBU 2000 | 100 parts) | |
| | Sulphur | 4 parts) | |
| | MgO | 2 parts) | |
| | ZnO | 2 parts) | |
| | Dioctyl azelate | 32 parts) | |
| | Di-(tertiary butyl)-para-cresol | 3.9 parts) | Binder 25% |
| | Stearic acid | 2.0 parts) | |
| | Siloxane | 0.4 parts) | |
| | Di-ortho-tolyl-guanidine | 2.0 parts | |
| | "Sotsit 5" (activated dithiocarbamate sold by Polyplastic) | 2.0 parts) | |
| Filler | p-phenylene-diamine | | 75% |

-continued

| | | |
|---|---|---|
| Viscosity of the mixture | 2,800 poises at 60° C. | |
| Curing temperature | 40° C - 15 days. | |
| Shore A hardness | 30. | |

EXAMPLE 5

This example illustrates the use of a polybutadiene/acrylonitrile copolymer binder.

| | | | |
|---|---|---|---|
| | Butadiene/acrylonitrile copolymer | 100 parts) | |
| | Sulphur | 4 parts) | |
| | MgO | 4 parts) | |
| | "Mayoline 280" (ESSO unsaturated mineral oil) | 32 parts) | Binder 20% |
| | Di-ortho-tolyl-guanidine | 2 parts) | |
| | Zn isopropyl xanthate | 2 parts) | |
| Filler | 2,4-Diamino-toluene | | 80% |
| Viscosity | 3,200 poises at 60° C. | | |
| Curing | 15 days at 40° C | | |
| Shore A hardness | 30. | | |

EXAMPLE 6

This example illustrates the use of an unsaturated polyester binder. Norsodyne NS 85, NS 44 and NS 66 are unsaturated polyesters distributed by Charbonnage de France Chimie.

| | | | |
|---|---|---|---|
| | Unsaturated polyester NS 85, NS 44 and NS 66 | 100 parts) | Binder 25% |
| | Cyclohexanone peroxide | 1.5 parts) | |
| | Lead octoate | 0.5 parts) | |
| Filler | 2,4-Diamino-toluene | | 75% |
| Viscosity of the mixture | 7,000 poises at 20° C. | | |
| Curing | 7 days at 60° C. | | |
| Shore A hardness | 80. | | |

EXAMPLE 7

This example illustrates the use of a carboxytelechelate polybutadiene binder vulcanised with sulphur and magnesium oxide.

The abbreviation CTPB 2000 denotes a carboxytelechelate polybutadiene having an average molecular weight of 2,000.

| | | | |
|---|---|---|---|
| | CTPB 2000 | 100 parts) | |
| | Sulphur | 4 parts) | |
| | MgO | 2 parts) | |
| Plasticiser | "Mayoline 280" | 2 parts) | Binder 25% |
| Anti-oxidant | Di-(tertiary butyl)-para-cresol | 2.8 parts) | |
| Wetting agents | Stearic acid | 0.7 parts) | |
| | Siloxane | 0.7 parts) | |
| Vulcanisation accelerator | Di-orto-tolyl guanidine | 2.0 parts) | |
| | Zn isopropyl xanthate | 2.0 parts) | |
| Filler | 2,4-Diamino-toluene | | 75% |
| Viscosity of the mixture | 5,500 poises at 60° C. | | |
| Curing | 10 days at 60° C. | | |

EXAMPLE 8

This example illustrates the influence of the plasticiser on the viscosity of the mixture at casting, as compared with the composition of Example 7.

| | | | |
|---|---|---|---|
| | CTPB 2000 | 100 parts) | |
| | Sulphur | 6 parts) | |
| | MgO | 4 parts) | |
| Plasticiser | Xylidine | 33 parts) | |
| Anti-oxidant | Di-(tertiary butyl)-para-cresol | 2.9 parts) | Binder 25% |
| Wetting agent | Stearic acid | 2.0 parts) | |
| Vulcanisation accelerator | Di-ortho-tolyl-guanidine | 2.0 parts) | |
| | Zinc isopropyl xanthate | 4.0 parts) | |
| Filler | 2,4-Diamino-toluene | | 75% |
| Viscosity | 25,400 poises at 60° C | | |
| Curing | 10 days at 60° C. | | |

EXAMPLE 9

This example illustrates the use of a binder cross-linked with an epoxide/aziridinyl mixture. "Epon 812" is an epoxide marketed by SHELL.

| | | | |
|---|---|---|---|
| | CTPB 2000 | 100 parts) | |
| Cross-linking agents | "Epon 812" | 15.2 parts) | |
| | trimethylaziridinyl-phosphine oxide | 3.5 parts) | |
| Plasticiser | Xylidine | 36 parts) | Binder 25% |
| Wetting agent | Siloxane | 3.1 parts) | |
| Catalysts | Diazabicyclooctane | 0.3 parts) | |
| | Iron acetylacetonate | 0.06 parts) | |
| Filler | 2,4-Diamino-toluene | | 75% |
| Viscosity at casting | 50,000 poises at 60° C. | | |

EXAMPLE 10

This example illustrates, by comparison with Example 9, the influence of changing the amine on the viscosity of the mixture at casting.

| | | | |
|---|---|---|---|
| | CTPB 2000 | 100 parts) | |
| Cross-linking agents | "Epon 812" | 18.2 parts) | |
| | trimethylaziridinyl-phosphine oxide | 2.1 parts) | Binder 25% |
| Plasticisers | Dioctyl azelate | 36 parts) | |
| Catalyst | Iron acetylacetonate | 0.06 parts) | |
| Filler | Melamine | | 75% |

The viscosity at casting (50° C) was 20,000 poises. The resulting solid component was more flexible and better agglomerated than when 2,4-diamino-toluene was used as the amine.

EXAMPLE 11

This example illustrates the use of a binder consisting of a mixture of carboxytelechelate polybutadines and polyfunctional organic acids. "Empol 1040" is a mixture of liquid organic polyacids manufactured by UNILEVER - EMERY.

| | | | |
|---|---|---|---|
| | "Empol 1040" | 50 parts) | |
| | CTPB 2000 | 50 parts) | |
| Cross-linking agents | "Shell 162" | 17.7 parts) | |
| | trimethylaziridinyl-phosphine oxide | 2.1 parts) | Binder 25% |
| Plasticiser | Fuel | 36 parts) | |
| Catalysts | Diazabicyclooctane | 0.3 parts) | |
| | Iron acetylacetonate | 0.06 parts) | |
| Filler | 2,4-Diamino-toluene | | 75% |

The strength of the solid component at 60° C was good, but the gel time was very short and casting was difficult.

The use of "Empol 1040" alone as the carboxylic prepolymer combined with melamine as the filler gave better castability and a longer gel time (about 1 hour at 60° C). The manner in which the strength varied with temperature was also good.

EXAMPLE 12

This example illustrates the use of a carboxytelechelate polybutadiene binder plasticised with fuel. The cross-linking agent "Shell 162" is an epoxide marketed by SHELL.

| | | | |
|---|---|---|---|
| | CTPB 2000 | 100 parts) | |
| Cross-linking agents | "Shell 162" | 17.7 parts) | |
| | trimethylaziridinyl-phosphine oxide | 4.2 parts) | Binder 25% |
| Plasticiser | fuel | 37 parts) | |
| Anti-oxidant | Di-(tertiary butyl)-para-cresol | 3.2 parts) | |
| Catalyst | Iron acetylacetonate | 0.06 parts) | |
| Filler | 2,4-Diamino-toluene | | 75% |

EXAMPLE 13

This example illustrates the use of a polyurethane binder.

| | | | |
|---|---|---|---|
| | "Polyol TP 740" | 100 parts) | |
| | Toluene diisocyanate | 40.5 parts) | |
| Plasticizer | Dioctyl azelate | 56 parts) | Binder 30% |
| Catalyst | Zinc dimercaptobenz-imidazolate | 0.2 parts) | |
| Filler | Melamine | | 70% |

In this composition the ratio (NCO/OH) is 1.1, Polyol TP 740 being a polyalcohol supplied by PECHINEY-UGINE KUHLMANN.

The viscosity at casting was 4,000 poises at 50° C.

EXAMPLE 14

The composition was identical with the composition of Example 13, with the exception that "Polyol TP 740" was replaced by "Polyol TP 1540" (supplied by the same company) and the catalyst was 0.02 part of iron acetylacetonate.

The table below gives the rates of combustion for some of the compositions given as examples.

The abbreviation MDAT denotes 2,4-diamino-toluene.

| Example No. | Binder | Plasticiser | Filler Diamino toluene | Rate of combustion in mm/second |
|---|---|---|---|---|
| 7 | Polyester (25%) | — | MDAT (75%) | 0.175 |
| 8 | CTPB vulcanised with sulphur (25%) | Mayoline | MDAT (75%) | 0.325 |
| 9 | CTPB vulcanised with sulphur (25%) | Xylidine | MDAT (75%) | 0.380 |
| 10 | CTPB cross-linked by an epoxy-aziridinyl mixture (25%) | Xylidine | MDAT (75%) | 0.700 |
| 11 | CTPB cross-linked by an epoxy-aziridinyl mixture (25%) | Dioctyl azelate | Melamine (75%) | 0.320 |
| 15 | Polyurethane (30%) | Dioctyl azelate | Melamine (70%) | 0.330 |

It is apparent from this table that the compositions which have the highest rates of combustion are those containing acid groups cross-linked by means of epoxides and aziridinyls, compositions containing 2,4-diamino-toluene giving higher rates of combustion than those containing melamine, but being less easy than the latter to process. Compositions containing a diene binder have the lowest rates of combustion, but are the easiest to process.

Compositions according to the invention enable the solid components of hybrid propellants to be readily manufactured. Since combustion using a hybrid propellant system normally takes place in two stages, namely rapid combustion in a pre-chamber and slow combustion in a chamber, it is possible, by means of the present invention, to use a rapid combustion composition to manufacture a pre-chamber block and a slow combustion composition to manufacture a chamber block.

What is claimed is:

1. A solid component for a hybrid propellant, which comprises
   1. a solid amine which is 2,4-diamino-toluene, 2,6-diamino-toluene, or melamine, and
   2. an organic liquid binder, said binder comprising functional groups capable of being cross-linked by an agent containing a cross-linking grouping selected from the group consisting of epoxide and aziridinyl groupings, being capable of hardening at a temperature lower than the melting point of said amine, said binder being a member selected from the group consisting of carboxytelechelate polybutadienes, carboxytelechelate polybutadiene/styrene copolymers, carboxytelechelate polybutadiene/acrylonitrile copolymers and mixtures thereof with a liquid organic polyacid, the proportion of said binder being more than 15% by weight, based on the solid component.

2. A solid component according to claim 1, wherein said cross-linking aziridinyl group is trimethylaziridinyl-phosphine oxide.

* * * * *